US007530357B2

(12) United States Patent
Edwards, Jr.

(10) Patent No.: US 7,530,357 B2
(45) Date of Patent: May 12, 2009

(54) SMOKING ENCLOSURE

(76) Inventor: Theodore C. Edwards, Jr., 284 Ashley Ave., Charleston, SC (US) 29403

( * ) Notice: Subject to any disclaimer, the term of this patent is extended or adjusted under 35 U.S.C. 154(b) by 643 days.

(21) Appl. No.: 10/911,894

(22) Filed: Aug. 5, 2004

(65) Prior Publication Data

US 2006/0027242 A1 Feb. 9, 2006

(51) Int. Cl.
*A24D 1/12* (2006.01)

(52) U.S. Cl. ..... 131/175; 131/187; 131/330; 131/329

(58) Field of Classification Search ..... None
See application file for complete search history.

(56) References Cited

U.S. PATENT DOCUMENTS 1,509,633 A * 9/1924 Bradshaw et al. ..... 131/223
2,216,920 A * 10/1940 Lykos et al. ..... 131/175
3,070,100 A 12/1962 Hicks et al.
3,757,803 A 9/1973 Chiang
3,975,857 A * 8/1976 Branson et al. ..... 43/61
4,077,784 A 3/1978 Vayrynen
4,131,119 A 12/1978 Blasutti
4,215,708 A 8/1980 Bron
4,233,998 A 11/1980 Radey, Jr.
4,258,730 A * 3/1981 Tsukamoto ..... 131/330
4,260,523 A 4/1981 Tsukamoto
4,620,553 A * 11/1986 Bale et al. ..... 131/198.1
4,676,259 A * 6/1987 Ellis et al. ..... 131/335
4,790,332 A 12/1988 Wallace
5,353,814 A * 10/1994 Martin ..... 131/215.2
5,695,214 A * 12/1997 Faigle et al. ..... 280/735
5,865,185 A 2/1999 Collins et al.
6,345,625 B1 * 2/2002 Chew ..... 131/202

* cited by examiner

*Primary Examiner*—Philip C Tucker
*Assistant Examiner*—Michael J Felton
(74) *Attorney, Agent, or Firm*—B. Craig Killough; Ernest B. Lipscomb, III

(57) ABSTRACT

A cigarette or cigar is contained within an enclosure. The enclosure comprises filters that reduce tar output to the surrounding atmosphere. The device has a mouthpiece that collects and introduces additional oxygen into smoke prior to the smoke being ingested by the smoker, thereby reducing levels of carbon monoxide, and oxidizing components of the tar.

15 Claims, 3 Drawing Sheets

SMOKING ENCLOSURE

FIELD OF THE INVENTION

This invention relates to cigar and cigarette holders generally, and is more specifically directed to an enclosure for holding a burning cigar or cigarette and reducing the harmful effects of smoke produced thereby.

BACKGROUND OF THE INVENTION

The term "second hand smoke" refers to smoke that is discharged by a cigar or cigarette that is received by a person other than the smoker of the cigar or cigarette. In enclosed areas, such as rooms, persons in the area who do not smoke are subjected to the harmful effects of second hand smoke. Two of the harmful components of tobacco smoke are carbon monoxide, and what is referred to as "tar." These materials are components of second hand smoke. There is a need for a device that will reduce the output of these harmful materials that are contained in second hand smoke.

SUMMARY OF THE INVENTION

The present invention is an enclosure for a cigar or cigarette. A cigarette is contained within the enclosure. The enclosure comprises filters that reduce tar output to the surrounding atmosphere. This device introduces additional oxygen into the smoke prior to the smoke being ingested by the smoker, reducing levels of carbon monoxide, and oxidizing components of the tar.

DESCRIPTION OF THE PREFERRED EMBODIMENTS

The term "cigarette" is used here to include any tobacco product or other smoking material that is ignited for the purpose of ingesting the smoke, including cigars.

Figure 1:
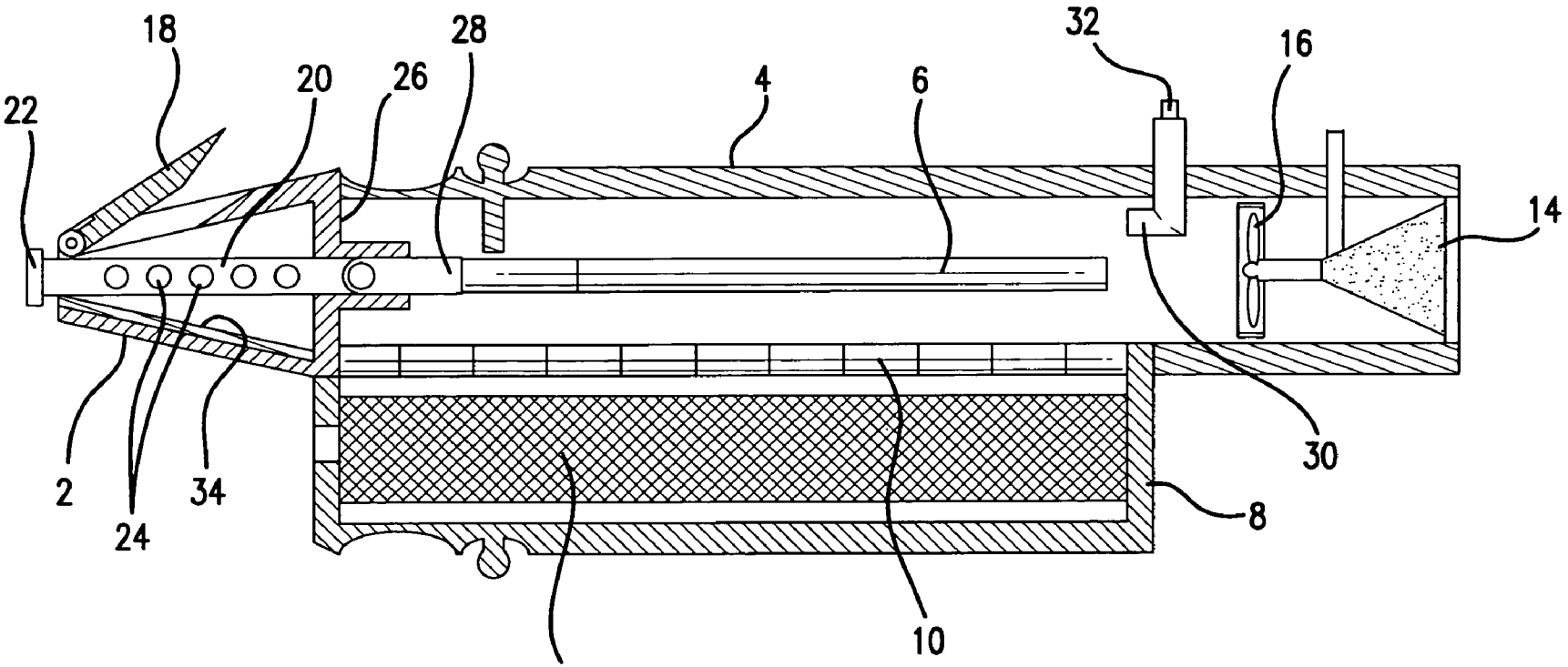
FIG. 1 is a section view of the device.

In FIG. 1, the cigarette enclosure comprises a mouthpiece 2 and a tank 4. A cigarette 6 is present within the tank, and is fully surrounded by the tank. The tank is preferred to have an access door 8 that is hinged 10 longitudinally relative to the tank. The door has a length that exceeds the length of the cigarette, so that the cigarette maybe easily placed within the device. When the hinged door is closed, the tank may fully surround a burning cigarette.

The tank is preferred to have multiple vents, with filters covering each of the vents, so that air, and particular oxygen, can enter the tank. The filters also filter the smoke produced by the burning cigarette, and retain tar from the smoke within the enclosure. As shown in FIG. 1, the tank has a vent in the door that is covered by filter material 12. The tank may also have a vent on an opposite side of the tank that is covered by filter material. An additional vent is preferred to be present on the end of the tank, with the additional vent covered by filter material 14. In one embodiment of the device, the device has a small electric fan 16 which is used to provide additional ventilation, and therefore, additional oxygen for ignition of the cigarette. In another embodiment, the fan 16 forces smoke from the enclosure and through the filters.

The device comprises a mouthpiece at one end. It is preferred that the mouthpiece 2 is tapered toward an end of the mouthpiece that is opposite the cigarette, so that the user's lips will fit over the end of the mouthpiece.

The mouthpiece comprises a spring-biased door 18. The spring-biased door is hinged and is normally open, as shown in FIG. 1 and in FIG. 2. The door facilitates the transfer of outside air, and particularly oxygen, into the mouthpiece. When the user places his or her lips over the mouthpiece, the door is forced downward against the stop, and the door is closed. FIG. 3. The user then draws smoke from the cigarette through the conduit 20 and the insert 22.

The cigarette is inserted into and joins a conduit. On an end of the conduit that is opposite the cigarette, removable insert 22 is present. The conduit connects the cigarette with the insert. A portion of the insert is present in the user's mouth when the user is ingesting smoke. The conduit has a plurality of orifices 24 within the portion of the conduit that is in the mouthpiece. Oxygen enters the mouthpiece through the door, and is present in the mouthpiece. As the user draws smoke from the cigarette, oxygen is pulled through the orifices into the smoke, which oxidizes the carbon monoxide in the smoke and converts it to carbon dioxide. The additional oxygen also oxidizes materials within the tar. The presence of the orifices within the mouthpiece prevents the user from placing his or her fingers or lips over the orifices, which would block the orifices. Further, the mouthpiece is separated from the tank by a wall or partition 26, so that smoke from the burning cigarette does not pollute clean air that has entered through opening provided by the door 18 and is present in the mouthpiece.

The insert 22 is positioned in the conduit, and communicates with the conduit. The insert is inserted into the conduit through an orifice in the end of the mouthpiece that is opposite the cigarette, and is retained within the conduit. The insert contains a filter, which filters the smoke, and which the filters tar from the smoke. Further, the insert may have supplemental nicotine present therein. Additionally, or alternatively, the conduit may have supplemental nicotine therein. The additional nicotine is provided to the user in a smokeless form, so that the user's desire for nicotine is supplied. The user is able to feed his or her nicotine requirement, while also having the sensation of smoking. However, the smoke that is ingested contains less of the harmful carbon monoxide and tar that is normally found in cigarette smoke. The insert is removable and may be replaced from time to time, to refresh the supplemental nicotine, and to provide a clean filter within the mouthpiece.

Figure 2:
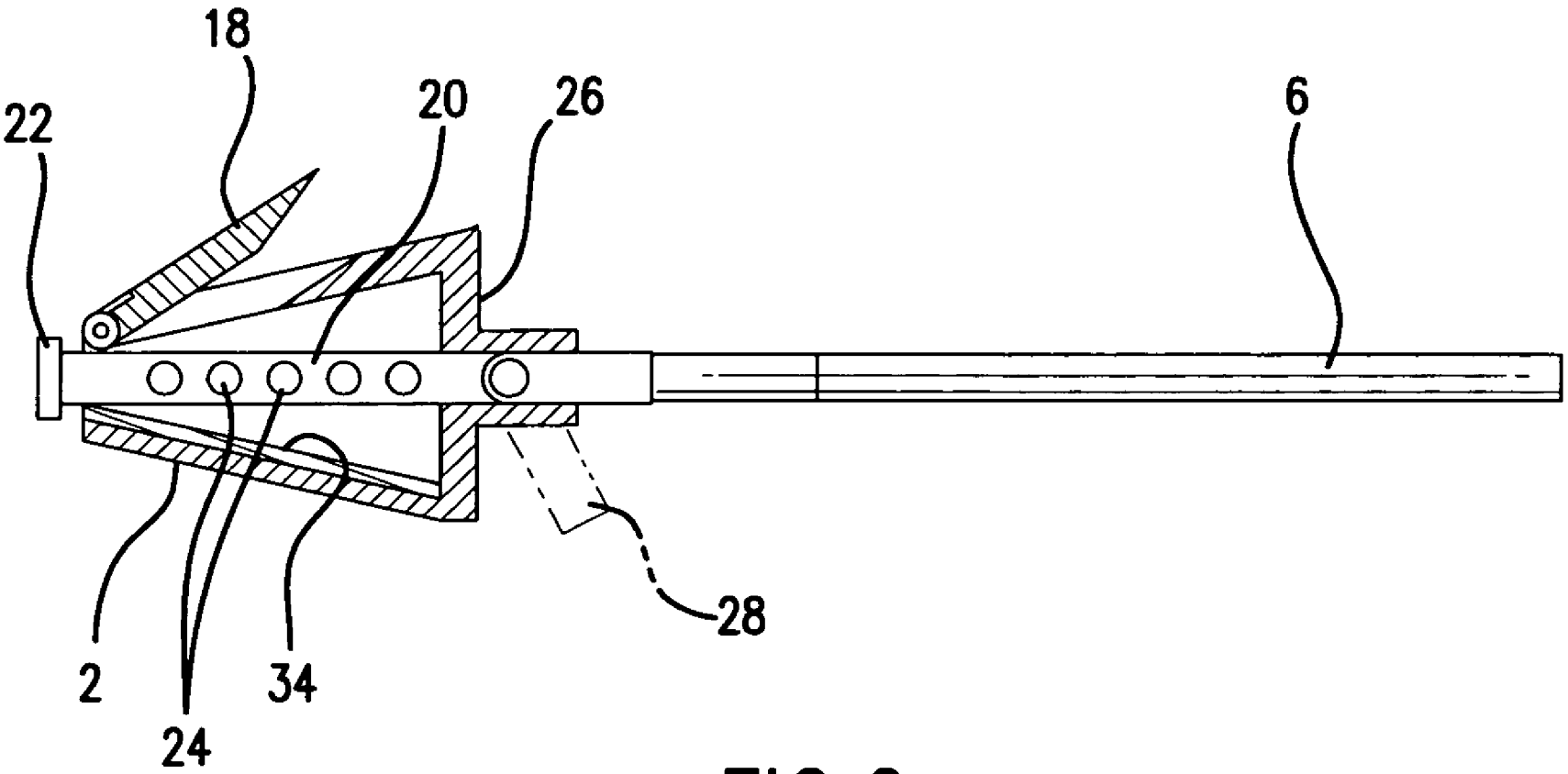
FIG. 2 is a sectioned isolation of the mouthpiece of the device.
Figure 3:
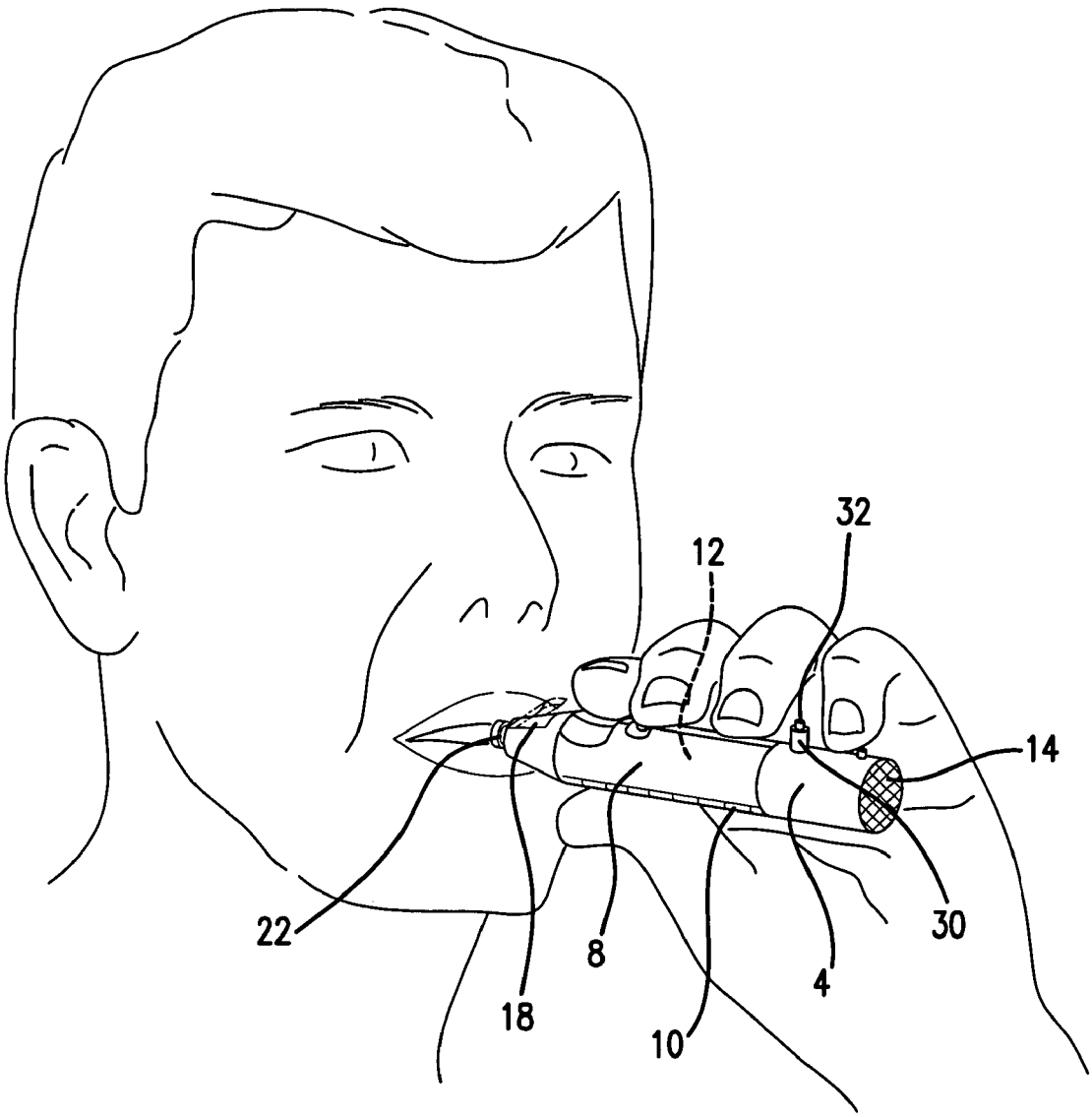
FIG. 3 is a perspective view of the device in use.

As shown in FIG. 2, in one embodiment of the device the end 28 of the conduit that is within the tank swivels relative to the mouthpiece and the remainder of the conduit. This pivoting action of the cigarette holder portion of the conduit allows the cigarette holder to be positioned for easy insertion of a new cigarette, and for easy removal of the cigarette butt after the cigarette has been consumed.

The device may comprise an integrated lighter 30. The integrated lighter is positioned within the tank near the end of a new cigarette of normal length. The actuator 32 for the lighter is accessible from an exterior of the tank. This allows the cigarette to be ignited after the cigarette is in position within the enclosure, and the door is closed. It is not necessary to light the cigarette from outside the enclosure after the cigarette is in position.

It is believed that the presence of a magnetic field within the device will also break down harmful chemicals in the tobacco. Accordingly, in one embodiment of the device, the interior of the mouthpiece is coated with, or otherwise has a magnet 34 affixed to, the interior thereof. An electrical current may supplement the magnetic field produced by the magnet. A battery may provide the electrical current.

The invention reduces the amount of second hand smoke that is emitted by the cigarette, while also reducing the tar and carbon monoxide that are ingested by the smoker. Further, when the device is properly used, it prevents fires associated with cigarette use, such as those fires associated with smokers falling asleep in bed with a burning cigarette.

What is claimed is:

1. A cigarette enclosure, comprising:

a) a mouthpiece, comprising a spring biased door on a portion thereof, wherein spring biasing urges said spring biased door away from a remaining portion of said mouthpiece to create an opening in said mouthpiece;

b) an insert removably attached to the outer end of a conduit that extents through said mouthpiece and communicating with the interior of said mouthpiece, said insert further comprises a filter;

c) a tank that extends from an end of said mouthpiece that is opposite said insert, wherein said tank surrounds a cigarette, and said tank has vent therein that allows air to enter said tank; and d) said conduit receives and holds said cigarette in the end of said conduit opposite said insert, said conduit communicating with said insert, and said conduit having a plurality of orifices therein that open within said mouthpiece.

2. A cigarette enclosure as described in claim 1, wherein a magnetic field is present in said mouthpiece.

3. A cigarette enclosure as described in claim 1, wherein an opening to said tank is hinged.

4. A cigarette enclosure as described in claim 1, wherein said tank is hinged longitudinally to provide an opening to said tank.

5. A cigarette enclosure as described in claim 1, further comprising means for producing a magnetic field within said mouthpiece.

6. A cigarette enclosure as described in claim 1, wherein said insert further comprises a nicotine source.

7. A cigarette enclosure as described in claim 1, wherein said mouthpiece further comprises a nicotine source.

8. A cigarette enclosure as described in claim 1, wherein said at least one vent in said tank comprises a filter.

9. A cigarette enclosure as described in claim 1, wherein a partition separates an interior of said mouthpiece from said tank and said partition prevents an air exchange between said mouthpiece and said tank.

10. A cigarette enclosure as described in claim 1, wherein said spring biased door is located on a surface of said mouthpiece that forms part of an exterior of said cigarette enclosure.

11. A cigarette enclosure as described in claim 10, wherein said opening opens to an exterior of said cigarette enclosure.

12. A cigarette enclosure as described in claim 11, wherein, when said spring biased door is positioned to close said opening, said mouthpiece is enclosed and air is transported from an interior of said mouthpiece into said plurality of orifices.

13. A cigarette enclosure, comprising:

a) a mouthpiece comprising spring biased door on a portion thereof, wherein spring biasing urges said spring biased door away from a remaining portion of said mouthpiece to create an opening in said mouthpiece, and wherein an interior of said mouthpiece comprises an air containing chamber;

b) a conduit that receives and holds the cigarette, said conduit having a plurality of orifices therein that open within said air containing chamber of said mouthpiece; and wherein said spring biased door is located on a surface of said mouthpiece that forms a portion of an exterior of said cigarette enclosure.

14. The cigarette enclosure as described in claim 13, wherein said opening opens to an exterior of said cigarette enclosure and said opening communicates with said chamber.

15. The cigarette enclosure as described in claim 14, wherein, when said spring biased door is positioned to close said opening, said chamber is enclosed and air is transported from an interior of said chamber into said plurality of orifices.

* * * * *